US007770837B1

(12) United States Patent
Head et al.

(10) Patent No.: US 7,770,837 B1
(45) Date of Patent: Aug. 10, 2010

(54) METHOD AND APPARATUS FOR SHIPPING BRAIDED COMPOSITE REINFORCING FABRIC

(75) Inventors: Andrew A. Head, Cincinnati, OH (US); Donald P. Exline, Florence, KY (US); Christopher M. Olenick, New Richmond, OH (US); Thomas C. Story, Cincinnati, OH (US)

(73) Assignee: A&P Technology, Inc., Cincinnati, OH (US)

( * ) Notice: Subject to any disclaimer, the term of this patent is extended or adjusted under 35 U.S.C. 154(b) by 411 days.

(21) Appl. No.: 11/825,824

(22) Filed: Jul. 9, 2007

Related U.S. Application Data

(60) Provisional application No. 60/819,157, filed on Jul. 7, 2006.

(51) Int. Cl.
*B65H 20/32* (2006.01)

(52) U.S. Cl. ..... 242/417.3; 242/160.1

(58) Field of Classification Search ..... 242/160.1, 242/160.2, 416, 419, 419.3, 419.8, 530, 530.1, 242/530.2, 538, 147 R, 155 R, 155 BW, 417.3
See application file for complete search history.

(56) References Cited

U.S. PATENT DOCUMENTS 4,069,359 A * 1/1978 DeMarse et al. ..... 428/36.5
4,685,190 A * 8/1987 Specht et al. ..... 29/452
5,899,134 A * 5/1999 Klein et al. ..... 87/9

* cited by examiner

*Primary Examiner*—John Q Nguyen
*Assistant Examiner*—William E Dondero
(74) *Attorney, Agent, or Firm*—Hahn, Loeser & Parks, LLP

(57) ABSTRACT

By the present invention method and apparatus is disclosed whereby a triaxial braided composite reinforcing fabric having axial yarns of varying length may be wrapped about a cylindrical shipping spool without deformation of the braided fabric. A tensioning device is interposed between the braiding tool and shipping or storage spool whereby the individual variable length axial yarns are subjected to constant tensioning. As the braided fabric is wound upon a cylindrical shipping spool, a conformable foam layer is interposed between each layer of braided fabric thereby permitting each axial yarn to seek out its own diameter by compressing the layer of conformable foam upon which it is wrapped.

2 Claims, 5 Drawing Sheets

METHOD AND APPARATUS FOR SHIPPING BRAIDED COMPOSITE REINFORCING FABRIC

RELATED APPLICATIONS

This application claims priority of Provisional Patent Application Ser. No. 60/819,157 filed on Jul. 7, 2006.

FIELD OF THE INVENTION

The present invention generally relates to a method and apparatus for winding multiple layers of a braided fibrous reinforcing fabric, or mat, upon a cylindrical shipping or storage spool. More specifically the present invention relates to method and apparatus for winding a triaxial braided reinforcing mat, having variable length axial yarns, upon a cylindrical shipping spool.

BACKGROUND

In the composite manufacturing industry it is common place to impregnate mats of reinforcing material, such as glass or carbon fibers, with a resinous matrix material and form the impregnated mat into a final complex shaped product by compression molding, or any other suitable means.

Various mat structures are used depending upon end use of the product manufactured. Typical are chopped strand mats, continuos strand mats having various strand patterns, woven fabric mats, and/or braided fabric mats. Braided fabric mats may comprise biaxial or triaxial braided fiber bundles or yarns. Each bundle, or yarn, comprising hundreds or thousands of continuos, parallel, fibers therein.

Biaxial braided fabrics basically comprise a cross weave of fibrous yarns wherein a matrix of parallel yarns are interwoven into an orthogonal matrix of parallel yarns thereby forming a braided fabric. A triaxial braided fabric basically comprises a biaxial braided fabric having an additional matrix of parallel yarns extending the longitudinal, or axial, length of the braided fabric and interwoven into the biaxial braided yarns.

In the manufacture of composite products the reinforcing fibrous mats are generally manufactured off-site and shipped to the composite manufacturer upon large shipping rolls having numerous concentric layers of reinforcing mat from which the composite manufacturer simply unrolls sheets of the reinforcing mat as needed. The mats are impregnated with resin, placed in a mold, such as a compression mold, and formed into the desired product.

Concave and/or convex products such as composite bathtubs and/or automobile body parts are typically manufactured in such a manner using chopped strand and/or woven fibrous mats while braided mats are generally used for manufacture of composite products serving a more structural function.

Chopped strand, woven, and biaxial braided mats will generally conform to a concave or convex configuration; however, triaxial braided mats formed on a cylindrical braiding spool will not conform to a convex or concave configured mold without characteristic buckling of the axial yarns because the axial yarns are of equal axial lengths.

Triaxial braided fabrics generally find use in reinforcement of cylindrical composite products such as large diameter pipe where the axial yarns extend parallel to the pipe centerline thereby providing tensile strength in the axial direction with the biaxially braided yarns wrapping around the circumference of the pipe providing burst strength. For example see U.S. Pat. No. 5,899,134.

However, it is sometimes desirable to wrap a triaxially braided fabric circumferentially about a cylindrical product with the axial yarns wrapping circumferentially about the cylinder providing hoop type reinforcement.

However, if the end product is not truly cylindrical and has an axially varying diameter, such as a aircraft turbine engine cowling, a triaxial braided fabric will form an undesirable buckle in areas where the end product diameter varies. Normally, in such constructions, the triaxial braided reinforcing fabric would have to be braided directly upon the manufacturing mold thereby avoiding buckling of the axial yarns. Thus off site preparation of the triaxial braided reinforcing fabric is not suitable.

Thus a method is needed whereby a triaxial braided reinforcing fabric having variable length axial yarns may be manufactured off site, and wrapped upon a generally cylindrical shipping spool that will accommodate the variable length axial yarns of the triaxially braided fabric and delivered to the end user.

BRIEF DESCRIPTION OF THE INVENTION

To solve the aforementioned problem the herein disclosed invention permits a triaxially braided fabric, having variable length axial yarns, to be circumferentially wrapped about a cylindrical storage or shipping spool without distortion of the fabric.

By the present method and apparatus a triaxially braided fabric having axial yarns of differing length may be circumferentially wrapped about a cylindrical storage or shipping spool without distortion of the fabric.

In accord with the present invention each of the variable length axial yarns are individually kept under constant tension by a suitable tensioning device between the braiding tool and the shipping spool. A layer of shape memory, compressible foam is first circumferentially applied to the cylindrical shipping spool. The triaxially braided fabric is then wrapped atop the foam whereby the variable length axial yarns will seek out their own diameter by compression of the compressible foam. Multiple layers of triaxially braided fabric may be applied to the shipping spool having layers of compressible foam inserted there between.

DETAILED DESCRIPTION OF THE INVENTION

Figure 1:
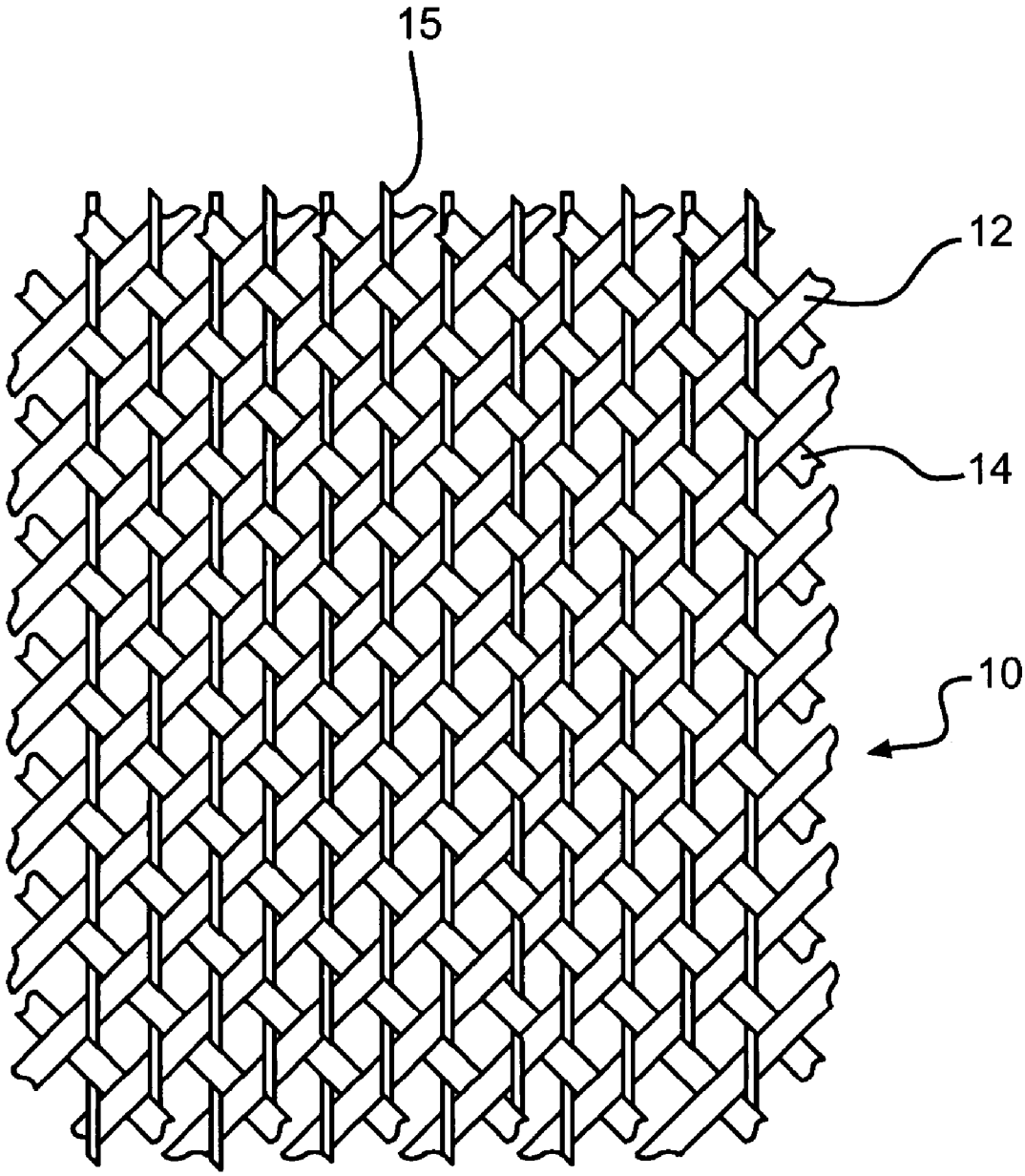
FIG. 1 (PRIOR ART)
FIG. 1 presents a diagrammatic view of a triaxially braided fabric having axially extending yarns.

FIG. 1 illustrates a typical triaxial braided resin reinforcing fabric 10 typically used in composites requiring great longitudinal and lateral strength. Fabric 10 basically comprises a biaxial braided fabric having angularly braided yarns 12 and 14 with additional axial or longitudinally extending yarns 15 braided therein as illustrated. Axial yarns 15 are illustrated as being of a smaller size than yarns 12 and 14 for illustration purposes only. Generally all braided yarns are of the same weight and size. However, they may be varied depending upon the product being manufactured.

Generally bias yarns are set at opposing forty five degree angles to the longitudinal axis of the fabric as illustrated in FIG. 1. However, yarns 12 and 14 may be set at any desired bias angle depending upon the end use.

Figure 2:
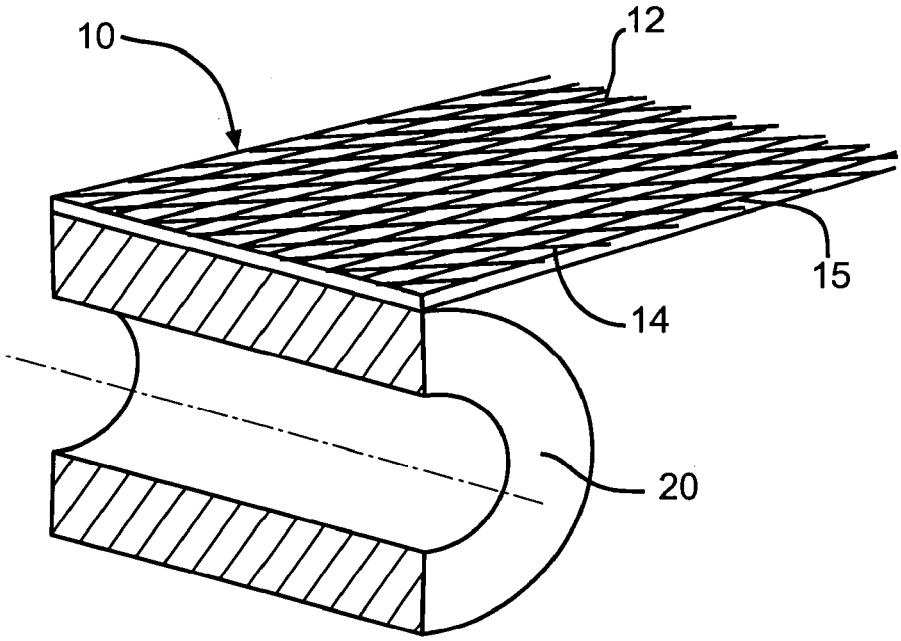
FIG. 2 (PRIOR ART)
FIG. 2 presents a crossectional, pictorial view of a triaxially braided fabric circumferentially wrapped about a cylindrical form.

FIG. 2 diagrammatically illustrates a triaxially braided fabric being wrapped upon a cylindrical form 20. Since form 20 is a true cylinder, triaxial braided fabric 10 will wrap smoothly about form 20 as the circumference of the cylinder is uniform in the cylinder's axial direction.

Figure 3:
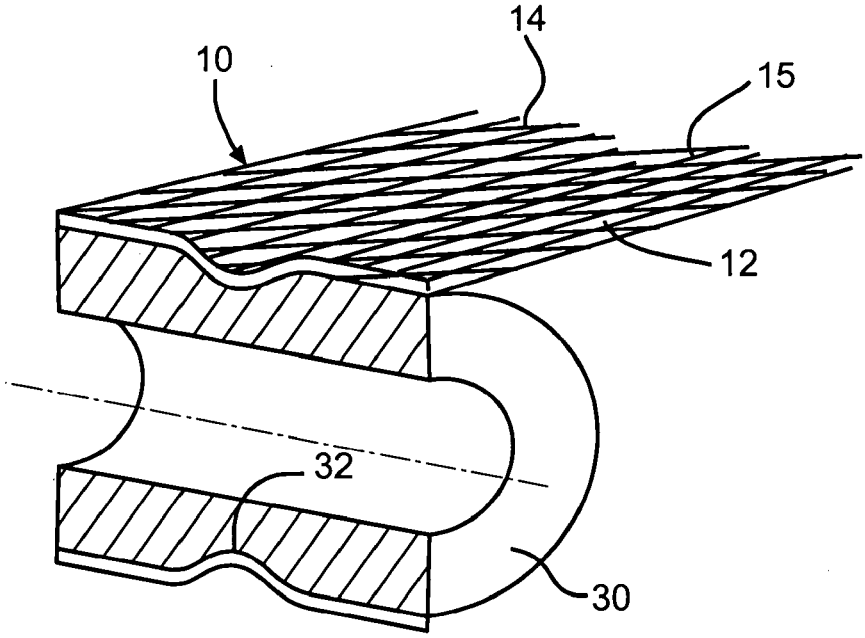
FIG. 3 (PRIOR ART)
FIG. 3 presents a crossectional pictorial view of a triaxially circumferentially wrapped about a cylindrical form having an area of reduced diameter.

However, if the form includes a concave portion 32, as illustrated in FIG. 3, the circumference of form 30, at concave portion 32, is smaller than that of the remainder of the form. Thus if a triaxially braided fabric 10 of FIG. 2 is wrapped circumferentially about form 30, the axial yarns 15 will be too long for the reduced circumference of concave portion 32 and will cause axial yarns 15 to buckle outwardly from the tool's circumferential surface.

Such buckling of the fabric within the area of the concavity 32 is unacceptable, particularly in the aerospace industry.

In the composite manufacturing industry it is common practice to form triaxially braded reinforcing fabric off site by a subcontract supplier that places the braided fabric upon a shipping spool from which the composite manufacturer unwinds the fabric.

If the triaxially braided fabric is intended to be wrapped circumferentially about a cylindrical product, or mold, having a variable diameter, as illustrated in FIG. 3, buckling of the axial yarns within the area of reduced diameter can not be avoided if the triaxial braided fabric is formed upon a braiding tool having a variable diameter and wrapped about a constant diameter shipping spool.

Figure 4:
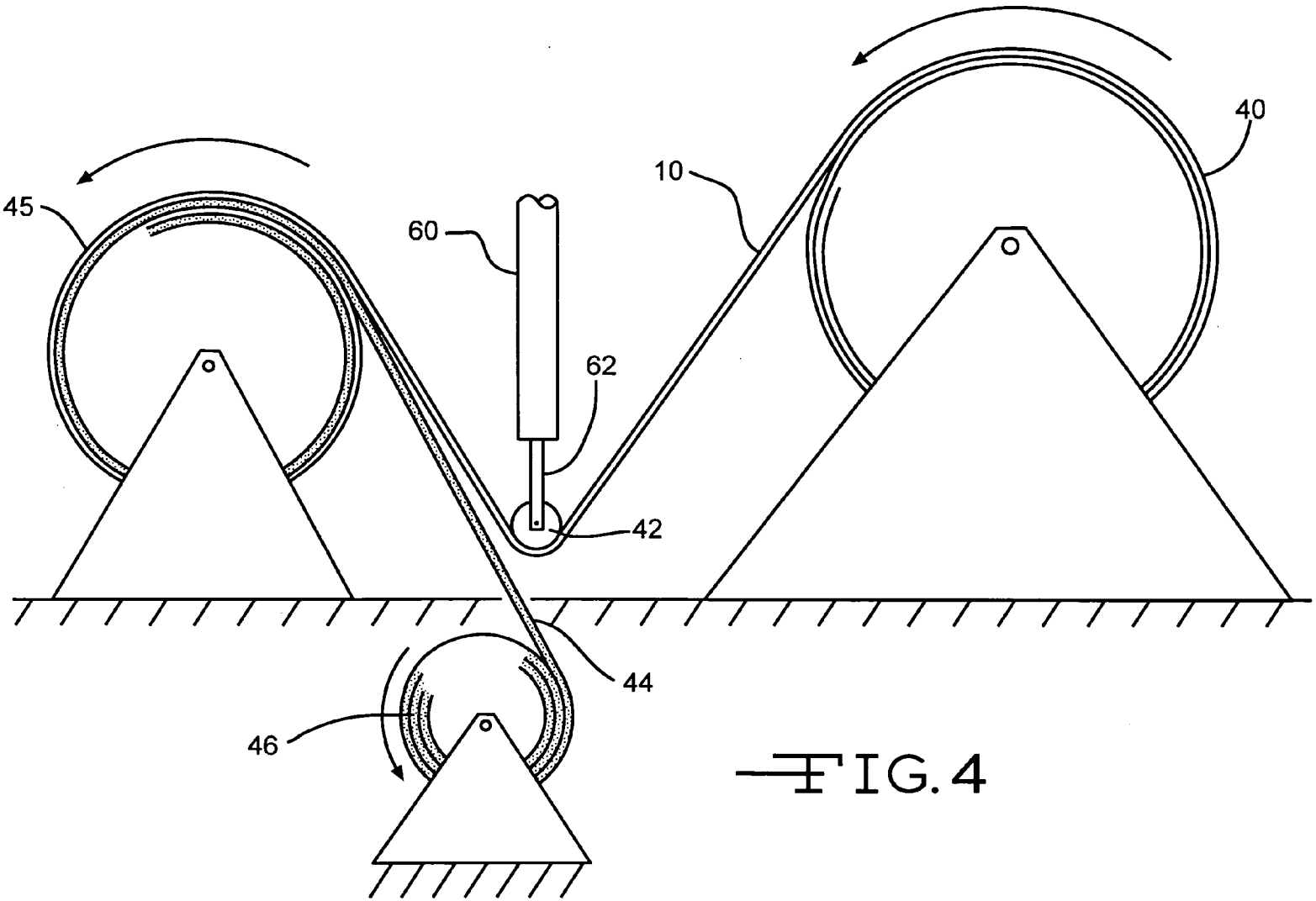
FIG. 4 schematically presents apparatus for circumferentially wrapping a triaxially braided fabric having variable length axial yarns upon a cylindrical shipping spool.

FIG. 4 schematically illustrates an axial tensioning method and apparatus for transferring a triaxially braided fabric, from a variable diameter braiding tool 40, wherein the fabric has variable length axial yarns and wrapping the fabric upon a cylindrical shipping spool 45 for shipment to the composite manufacturer.

As the triaxially braided fabric 10 is transferred from braiding tool 40 to shipping spool 45, tension is individually, and separately, applied to each and every individual axial yarn 15 by separate and independent tensioning rollers 42. As fabric 10 is wrapped about shipping spool 45 a continuous layer of conformable, shape memory, compressible, foam 44 is unwrapped from a roll of foam 46 and inserted between triaxially braided fabric 10 and cylindrical shipping spool 45. As multiple layers of triaxially braided fabric are wrapped upon shipping spool 45 a layer of shape memory, compressible foam is continuously inserted therebetween as illustrated in FIG. 4.

Figure 7:
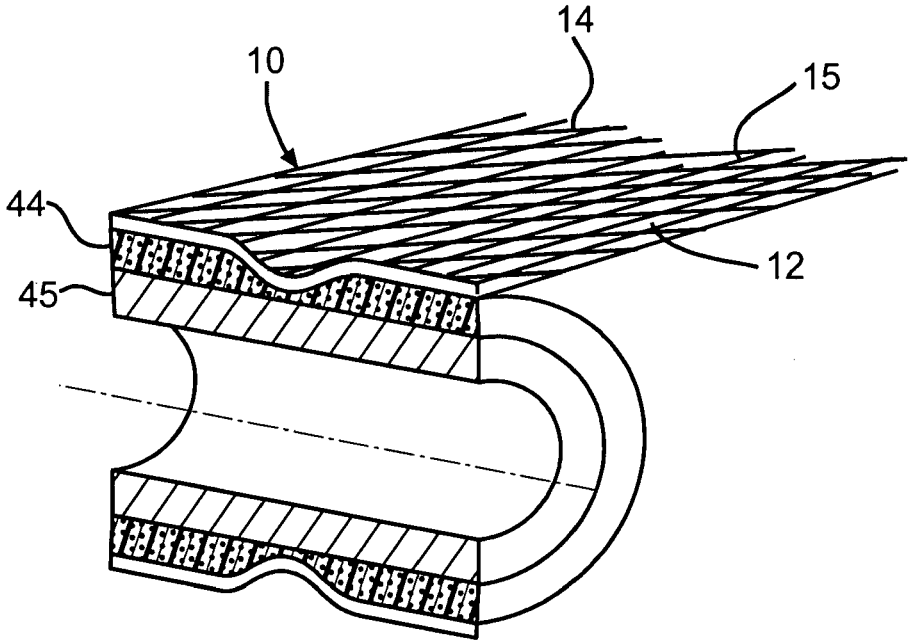
FIG. 7 presents a crossectional view of a triaxially braided fabric having variable length axial yarns circumferentially wrapped about a cylindrical shipping spool in accord with the present invention.

As triaxially braided fabric 10 wraps about shipping spool 45 each axial yarn will seek its appropriate diameter by compressing the shape memory, compressible foam layer beneath it as illustrated in FIG. 7. Thus multiple layers of triaxial braided fabric may be wrapped about shipping spool 45 with a layer of compressible foam therebetween without distorting any of the axial yarns.

Figure 5:
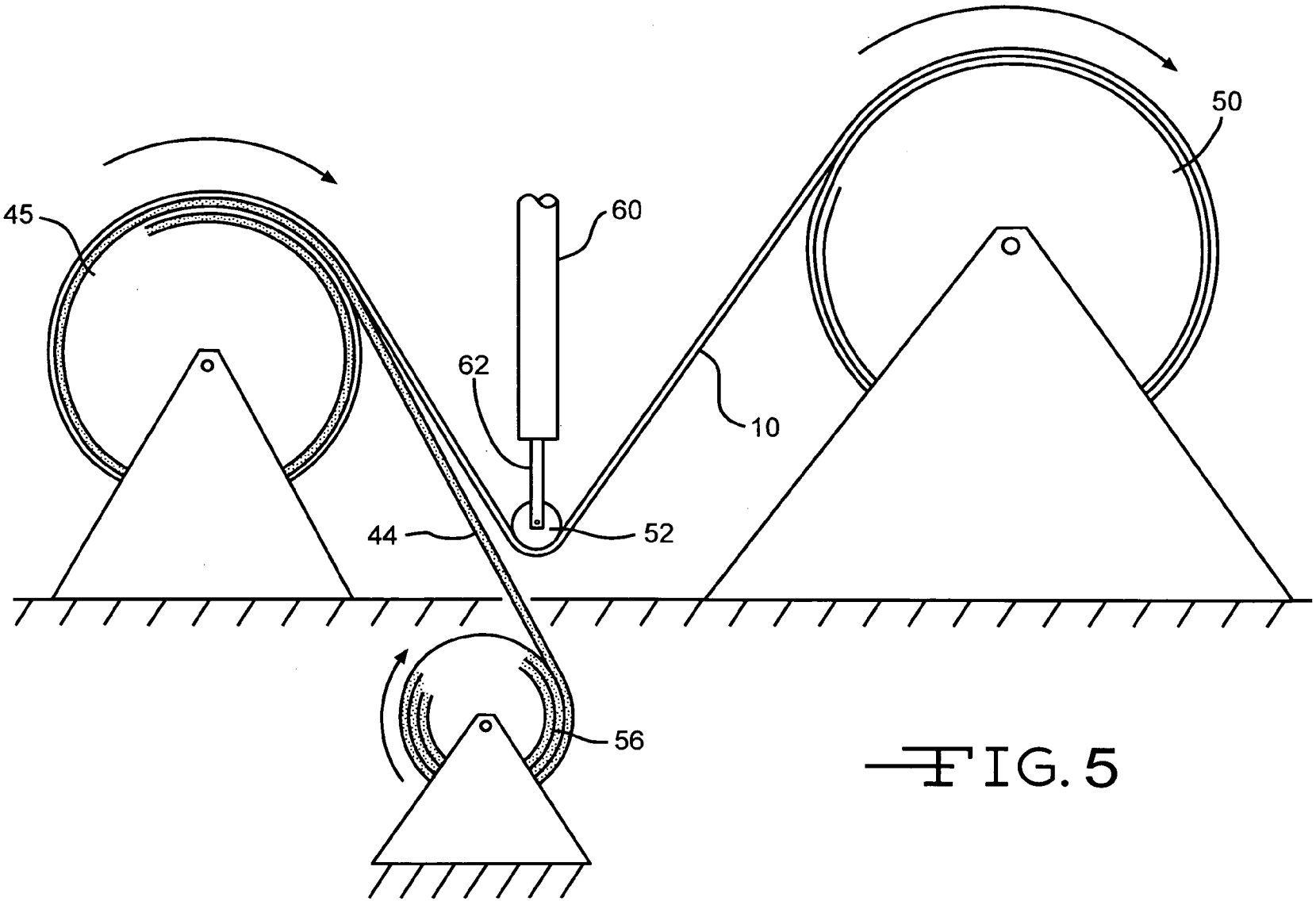
FIG. 5 schematically presents apparatus for removing triaxially braided fabric having variable length axial yarns from a cylindrical shipping spool.

FIG. 5 schematically illustrates method and apparatus for removal of the triaxially braided fabric 10 from shipping spool 45, by the composite manufacturer and applied to a composite forming mold 50 having the desired variable diameter configuration for which the triaxially braided fabric was intended.

Referring to FIG. 5, as the triaxially braided fabric is removed from shipping spool 45 and transferred to its intended variable diameter cylindrical composite forming mold 50, the individual and separate axial yarns within triaxial braided fabric 10, are again, individually and separately, maintained under tension by rollers 52 thereby preventing "slack" from occurring in each separate axial yarn 15. It is to be understood that unwrapping triaxial braided fabric 10 from shipping spool 45 and applying it to its intended composite molding tool 50 is a reversal of the process employed in transferring the triaxial braided fabric 10 from the braiding tool 40, in FIG. 4, to the shipping spool 45.

As triaxially braided fabric 10 is unwound from shipping spool 45, in FIG. 5, the shape memory, compressible foam 44 is rewound upon foam recovery spool 56. Recovery spool 56 with its recovered shape memory, compressible foam thereon may be returned to the triaxially braided fabric supplier for reuse.

Figure 6:
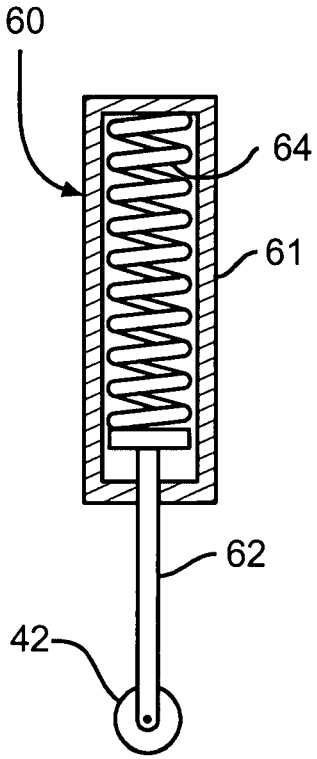
FIG. 6 presents a diagrammatic crossection of an axial yarn tensioning mechanism in accord with the present invention.

As illustrated in FIG. 6, axial yarn tensioning mechanism 60 may be as simple as a pressurized piston 62 within a cylinder 61 whereby a compression spring 64 forces roller 42 and 52 downward upon each of the separate axial yarns 15 thereby maintaining each axial yarn 15 under constant tension.

Yarn axial tensioning mechanism 60 may comprise a compression spring mechanism as illustrated in FIG. 6 or may comprise a fluidic or pneumatic system.

By the above described invention the triaxial braided fabric will not be deformed in any manner as tensioning rollers 42 will provide constant axial tensioning through out the winding of the braided fabric. The tension across the web section will provide consistent and specific axial tensioning for each winding (layer) of the braided fabric. The interspaced layers of conformable foam allows the braided fabric to be uniformly wrapped upon the shipping spool while maintaining a constant radius ratio between the shipping spool as the braided fabric diameter increases upon the shipping spool.

While we have described above the principles of our invention in connection with a specific preferred embodiment, it is to be clearly understood that this description is made only by way of example and not as a limitation of the scope of our invention as set forth in the accompanying claims.

We claim:

1. A method of wrapping a triaxially braided fabric having a multiplicity of axial yarns of varying length, braided therein, upon a cylindrical storage spool wherein said axial yarns are wrapped circumferentially about the cylindrical spool comprising the steps of:

a) providing a triaxially braided fabric having a multiplicity of axial yarns of varying length, b) wrapping a layer of conformable, shape memory, compressible foam about the circumferential periphery of said cylindrical spool, wrapping said triaxially braided fabric with said axial yarns wrapping circumferentially about said conformable, shape memory, compressible foam while applying a separate tensile force to each separate and individual axial yarn as the braided fabric wraps around said cylindrical storage spool while maintaining a substantially constant radius ratios between the spool and varying length axial yarns as the braided fabric diameter increases upon the spool.

2. A method of wrapping multiple layers of a triaxially braided fabric having a multiplicity of axial yarns of varying length, braided therein, upon a cylindrical storage spool wherein said axial yarns are wrapped circumferentially about the cylindrical storage spool comprising the steps of:

a) providing a triaxially braided fabric having a multiplicity of axial yarns of varying length, b) wrapping a first layer of conformable, shape memory, compressible foam about the circumferential periphery of said cylindrical spool, c) wrapping a first layer of triaxially braided fabric with said axial yarns wrapping circumferentially about said first layer of conformable, shape memory, compressible foam while applying a separate tensile force to each separate and individual axial yarn as the braided fabric wraps around said cylindrical storage spool, d) over laying said first layer of said triaxially braided fabric with a second layer of conformable, shape memory, compressible foam, e) over lying a second layer of triaxially braided fabric over lying said second layer of conformable, shape memory, compressible foam, f) repeating steps d and e until the desired layers of triaxial braided fabric have been applied to said storage spool while maintaining a substantially constant radius ratios between the spool and varying length axial yarns as the braided fabric diameter increases upon the spool.

* * * * *